US006361351B1

(12) United States Patent
Fujii

(10) Patent No.: US 6,361,351 B1
(45) Date of Patent: Mar. 26, 2002

(54) CONNECTOR FITTING STRUCTURE

(75) Inventor: Haruhiko Fujii, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 09/497,340

(22) Filed: Feb. 3, 2000

(30) Foreign Application Priority Data

Mar. 2, 1999 (JP) ..... 11-026010

(51) Int. Cl.[7] ..... H01R 13/64
(52) U.S. Cl. ..... 439/374; 439/544; 439/926
(58) Field of Search ..... 439/247, 248, 439/374, 373, 578, 544, 916, 926

(56) References Cited

U.S. PATENT DOCUMENTS 4,293,733 A * 10/1981 Royer ..... 174/67
5,151,047 A * 9/1992 Phillips ..... 439/333
5,297,972 A * 3/1994 McMills et al. ..... 439/133

FOREIGN PATENT DOCUMENTS

JP 5-58237 8/1993

* cited by examiner

*Primary Examiner*—Khiem Nguyen
(74) *Attorney, Agent, or Firm*—Crowell & Moring LLP

(57) ABSTRACT

A connector receptacle is protruded through an opening formed on a cabinet of a television receiver. At least one pair of enforcement ribs formed on the cabinet in vicinal horizontal side portions of the opening to support a connector fitted with the connector receptacle when the connector is accidentally moved by, for example, pulling an antenna code connected to the connector.

12 Claims, 5 Drawing Sheets

CONNECTOR FITTING STRUCTURE

BACKGROUND OF THE INVENTION

The present invention relates to a connector fitting structure wherein the connector is fitted to the connector receptacle provided on a cabinet by connecting the connector thereto.

FIG. 1 is rear view showing a cabinet 1 of a normal television receiver. In the cabinet 1, there is provided an opening 13 through which a connector receptacle 2 are protruded. FIG. 2 shows one example of a tuner section comprising such a connector receptacle. In the figure, the connector receptacle 2 is integrally provided with the tuner section 11 disposed on a circuit board 12 arranged inside of the cabinet 1. An antenna connector 10 shown in FIG. 3 is connected to the receptacle 2 to establish a connection between an antenna and the television receiver to receive television broadcasting.

As the connector fitting structure, there is one example wherein the antenna connector 10 shown in FIG. 3 is simply fitted with the connector receptacle 2. As another example, there is provided a connector receptacle as a male screw, and an antenna connector provided as a female screw is fixed to the connector receptacle in a screw-tightening manner.

FIG. 4 shows one example of the latter structure. In the figure, an antenna connector 3 as a female screw is fixed to a connector receptacle 2 as a male screw protruded through an opening 13 formed on a cabinet 1 of a television receiver. The reference numeral 4 denotes an antenna code 4.

In a case where a user attempts to move the cabinet 1 under when the antenna connector 3 is connected to the connector receptacle 2, there would be occurred that the antenna code 4 is irregularly and forcibly pulled. Generally, since the television receiver weights several kilograms, the inertial force becomes large considerably in such a case and thereby the pulling force acting on the antenna code 4 is also enlarged considerably. Especially in a case where the screw-tightening type of fitting structure is adopted, since the antenna connector 3 is firmly engaged with the connector receptacle 2, the antenna connector 3 cannot be disengaged even if the antenna code 4 is strongly pulled, thereby the connector receptacle 2 would be broken by a root portion thereof. There is known statistically such an accidental pulling force tends to act in the horizontal direction.

SUMMARY OF THE INVENTION

It is therefore an object of the present invention is to provide a connector fitting structure which is free of aforementioned disadvantage, wherein the connector is firmly fixed without being disconnected easily once the connector is fitted to the connector receptacle of the cabinet, and wherein the possibility of breakage by being pulled on the connector is reduced.

In order to achieve the above object, according to the present invention, there is provided a connector fitting structure comprising:

a cabinet having an opening;

a connector receptacle protruded through the opening;

a connector fitted with the connector receptacle; and at least one pair of enforcement ribs formed at horizontal side portions of the opening on the cabinet.

Preferably, the connector receptacle includes a portion formed into shape of a male screw, and the connector includes a member formed into shape of a female screw and engaged with the male-screw portion.

Here, the enforcement ribs are arranged such that the female-screw member abuts against the ribs when the connector is moved.

Here, the male-screw portion of the connector receptacle is exposed at least in the vertical side of the opening.

Preferably, the enforcement ribs are a pair of plate-like members extending in the horizontal direction.

Preferably, each of the enforcement ribs includes a rounded wall surrounding the horizontal side portion of the opening.

Preferably, the enforcement ribs are two pairs of plate-like members extending diagonally, and one end of the respective plate-like members is situated so as to surround the horizontal side portion of the opening.

Preferably, the connector is antenna connector.

Preferably, the enforcement ribs are integrally molded with the cabinet made of resin.

DETAILED DESCRIPTION OF THE PREFERRED EMBODIMENTS

Referring now in detail to the drawings, the connector fitting structure according to the invention will be described.

Figure 5A:
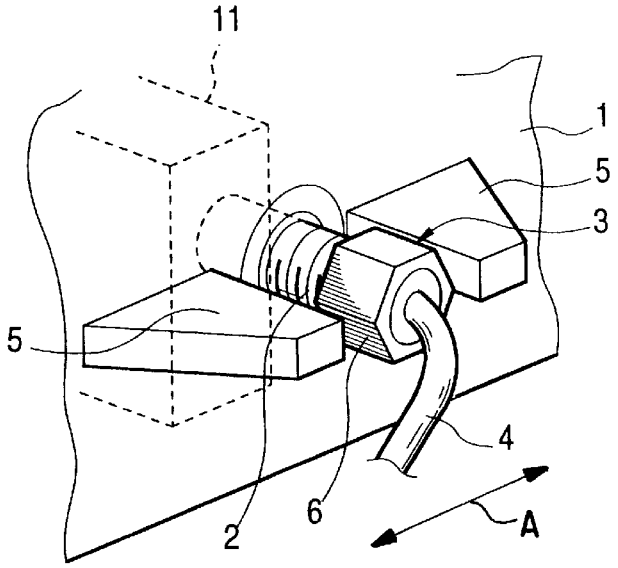
FIG. 5A is a perspective view of a connector fitting structure according to one embodiment of the present invention.
Figure 5B:
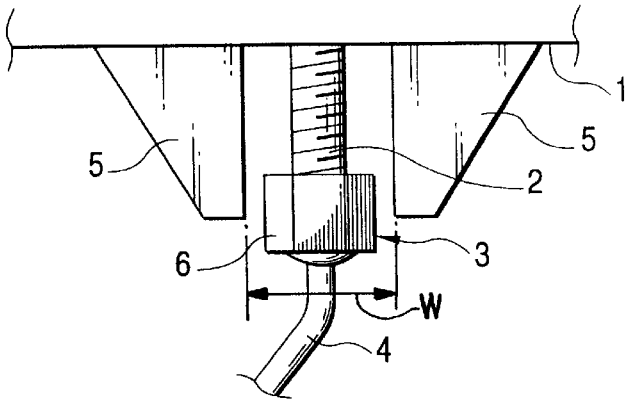
FIG. 5B is a plan view of the connector fitting structure of FIG. 5A.
Figure 5C:
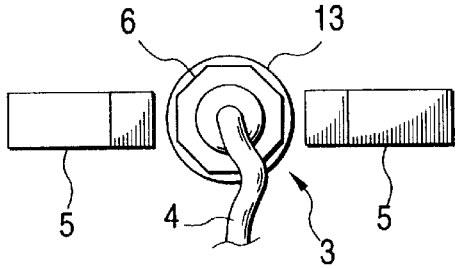
FIG. 5C is a front view of the connector fitting structure of FIG. 5A.

FIGS. 5A to 5C illustrate a connector fitting structure of a television receiver to be connected with the antenna for receiving television signals from the antenna according to one embodiment of the invention, wherein FIG. 5A is a perspective view, FIG. 5B is a plan view and FIG. 5C is a front view respectively thereof.

As shown in the figures, a connector receptacle 2 is protruded through an opening 13 formed on a cabinet 1 of the television receiver. A female screw portion 6 of an antenna connector 3 is fixed to the connector receptacle 2 in the screw-tightening manner. In the present embodiment, a pair of enforcement ribs 5 are formed in the vicinity of the opening 13 on the cabinet 1 such that the female screw portion 6 can be supported from horizontal side portion of the opening 13.

When the antenna code 4 is accidentally pulled if the user attempts to move the cabinet 1, the female portion 6 would abut against the enforcement ribs 5, thereby displacement and deforming of the antenna connector 3 can be restricted. Accordingly, the breakage of the connector receptacle 2 due to such an accident can be prevented.

The reason why the enforcement ribs 5 are formed only the horizontal side portion of the opening 13 is to effectively prevent the breakage due to the accidental pulling force which tends to act in the horizontal direction (indicated by an arrow A shown in FIG. 5A) as described above. In addition, such configuration can improve workability for screw-tightening conducted by pinching the female screw portion 6 because vertical side portions of the openings 13 is kept as free space. If an enforcement rib is formed so as to surround the opening 13 wholly, it is difficult to screw the female screw portion 6 into the connector receptacle 2.

The accidental breakage of the connector receptacle 2 may be avoided by providing a tuner section having more solid structure. However, since the enforcement ribs 5 of the present invention can be molded integrally with the cabinet 1 made of resin such as polystyrene, the manufacturing cost can be remarkably reduced as compared with the measure of which the shape of the tuner section is modified.

Figure 6:
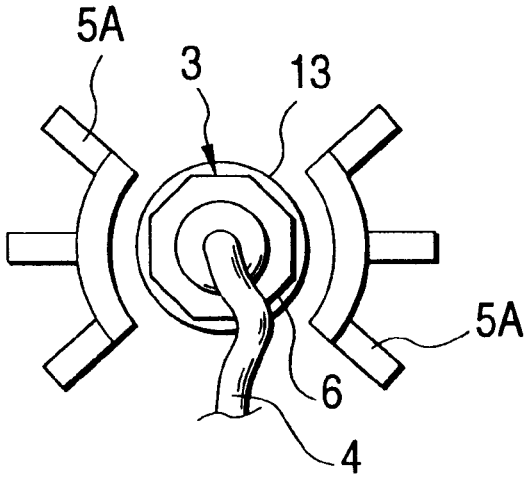
FIG. 6 is a front view of one modified example of the connector fitting structure of FIG. 5A.
Figure 7:
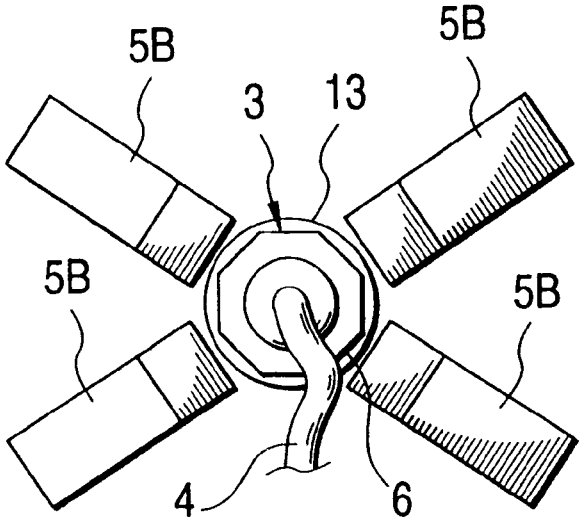
FIG. 7 is a front view of another modified example of the connector fitting structure of FIG. 5A.

As shown in FIG. 5B, the protruded height h of the enforcement ribs 5 is so determined as to extend to a portion where the female screw portion 6 tightened by the user situates. And the interval w between the enforcement ribs 5 is so determined as to be slightly wider than the diameter of the female screw portion 6. However, the shape of the enforcement ribs 5 is not limited to the above embodiment. If only the free space for screw-tightening is kept in the vertical side portion of the opening 13, the shape of the enforcement ribs can be modified as shown in FIGS. 6 and 7, for example. According to the enforcement ribs 5A or 5B of these examples, there may be adapted to pulling force for wider direction as compared with the shape of the enforcement ribs 5 as shown in FIG. 5.

Although the enforcement ribs of the present invention is effective especially for the screw-tightening type connector fitting structure, it is also applicable, as a matter of course, for the connector fitting structure wherein the antenna connector is simply fitted with the connector receptacle.

Figure 1:
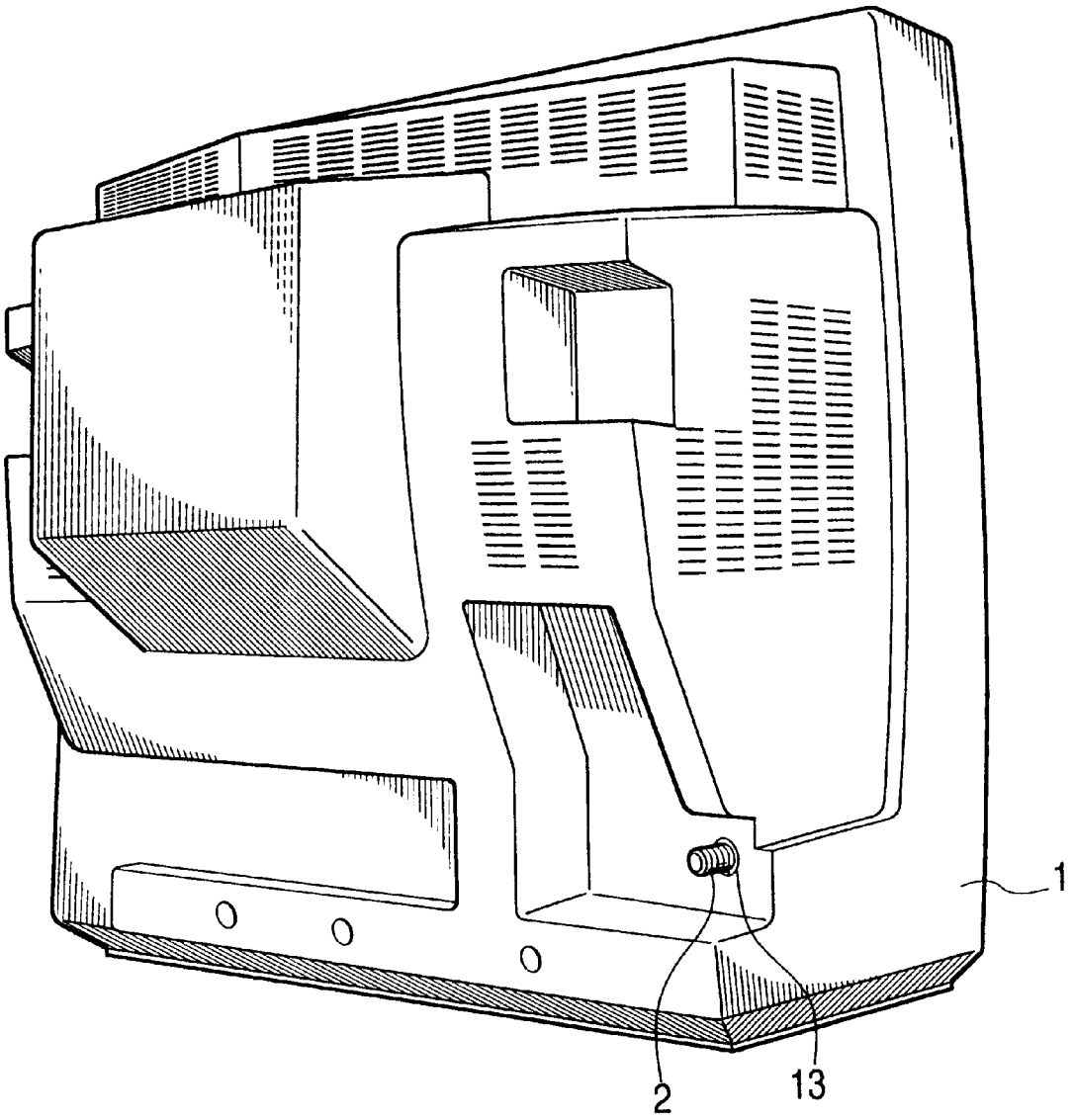
FIG. 1 PRIOR ART
FIG. 1 is a rear view showing a cabinet of a television receiver.
Figure 2:
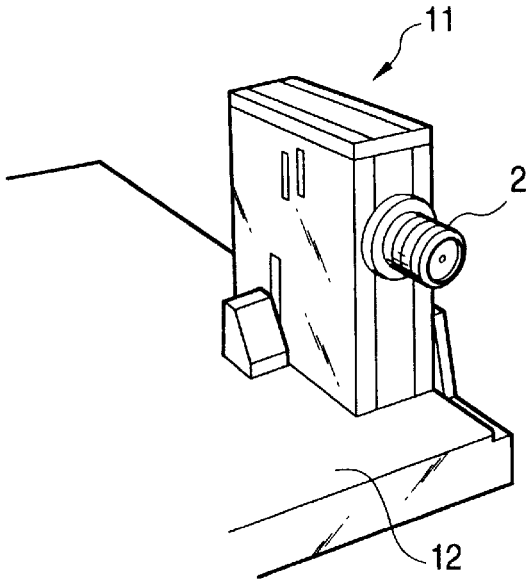
FIG. 2 PRIOR ART
FIG. 2 is a perspective view showing a tuner section having a connector receptacle which is disposed inside of the cabinet.
Figure 3:
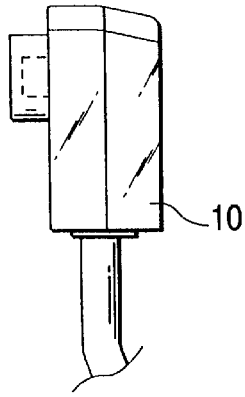
FIG. 3 PRIOR ART
FIG. 3 shows one example of an antenna connector.
Figure 4:
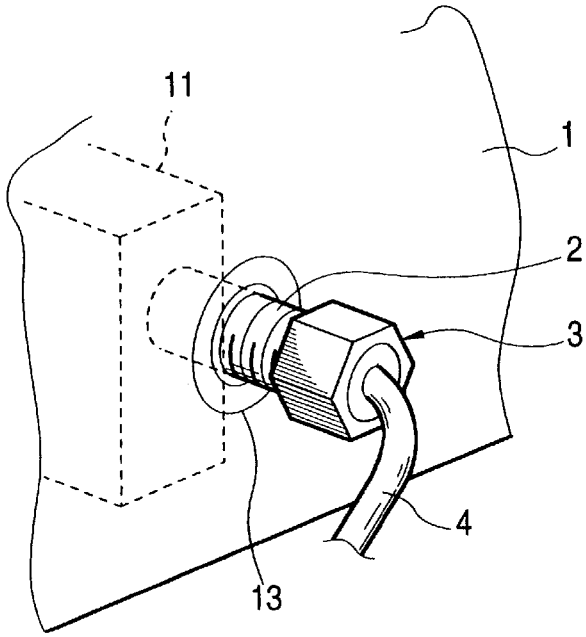
FIG. 4 PRIOR ART
FIG. 4 is a perspective view showing one example of a screw-tightening type connector fitting structure.
Figure 8:
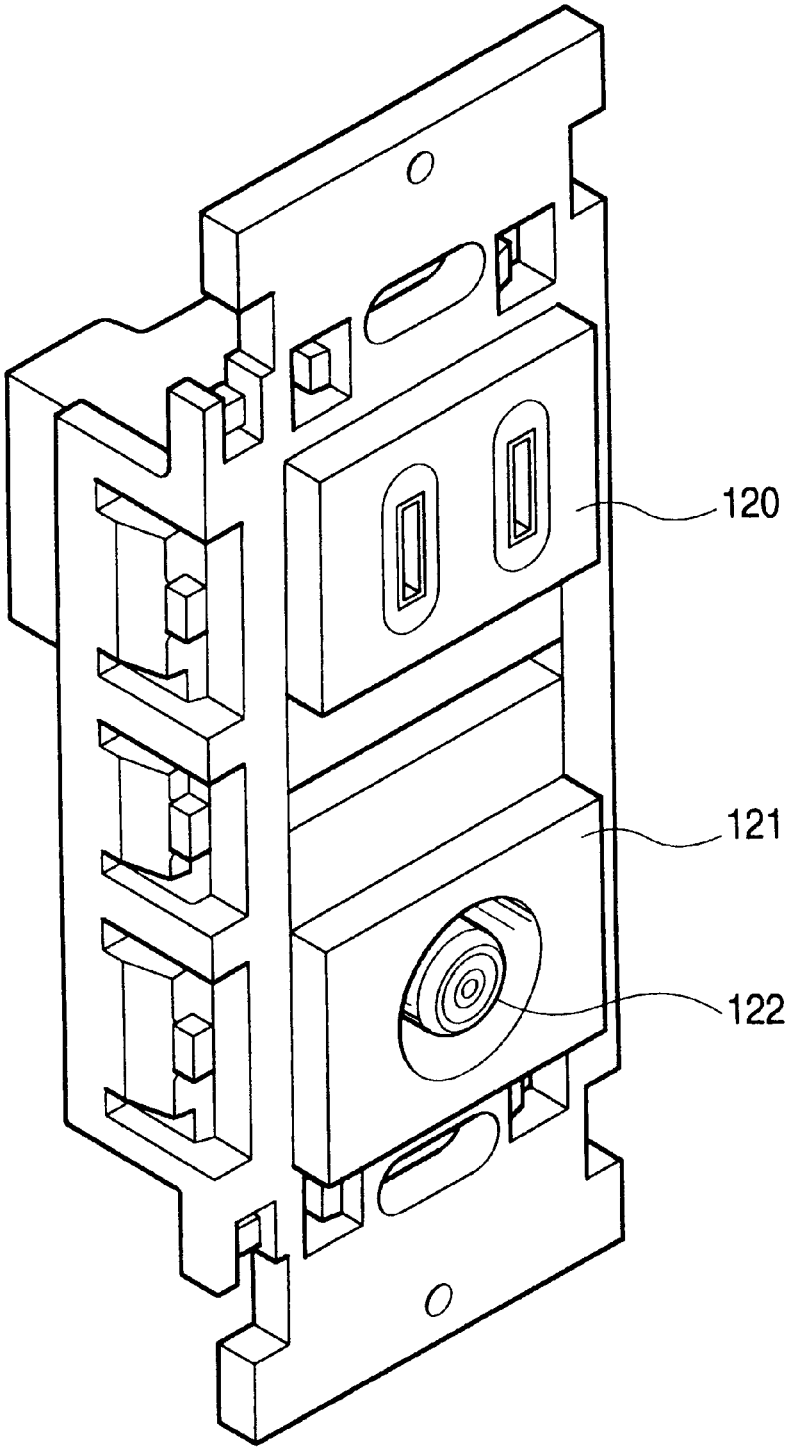
FIG. 8 PRIOR ART
FIG. 8 shows one example of a coaxial cable connector module to which the present invention can be applied.

Furthermore, it is also applicable for a connector fitting structure other than the antenna connector fitting structure of the television receiver as described above. For example, as shown in FIG. 8, there is disclosed in Japanese Patent Publication No. 5-58237B a coaxial cable connector module 121 provided with a wiring accessory module 120, which is fixed to the wall in the house, for example. In this structure, since an antenna plug such as shown in FIG. 3 is simply fitted with a receptacle 122, the antenna plug is easily come off when the antenna code is accidentally pulled. Providing the enforcement ribs as described above in the vicinity of the receptacle 122, the antenna code can be prevented from coming off even if the antenna code is pulled accidentally.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector fitting structure, comprising:

a cabinet having an opening;

a connector receptacle which protrudes through the opening to the outside of the cabinet so as to be exposed on its sides;

a connector adapted to mate outside the cabinet with the protruding connector receptacle; and at least one pair of enforcement ribs fixed on the cabinet only about substantially horizontal side portions of the opening while keeping the substantially vertical side portions clear of any access inhibiting obstructions, said ribs extending away from the cabinet so as to restrict horizontal movement of the protruding connector receptacle, whereby breakage due to said movement is prevented.

2. The connector fitting structure as set forth in claim 1, wherein the connector receptacle includes a portion formed into shape of a male screw, and the connector includes a member formed into shape of a female screw and engaged with the male-screw portion.

3. The connector fitting structure as set forth in claim 2, wherein the enforcement ribs are arranged such that the female-screw member abuts against the ribs when the connector is moved.

4. The connector fitting structure as set forth in claim 1, wherein the connector is an antenna connector.

5. The connector fitting structure as set forth in claim 1, wherein the enforcement ribs are a pair of plate-like members extending in the horizontal direction.

6. The connector fitting structure as set forth in claim 1, wherein each of the enforcement ribs includes a rounded wall surrounding the horizontal side portion of the opening.

7. The connector fitting structure as set forth in claim 1, wherein the enforcement ribs are two pairs of plate-like members extending diagonally, and one end of the respective plate-like members is situated in the horizontal side portion of the opening.

8. The connector fitting structure as set forth in claim 2, wherein the male-screw portion of the connector receptacle is exposed at least in the vertical side of the opening.

9. The connecting fitting structure as set forth in claim 1, wherein the enforcement ribs are integrally molded with the cabinet made of resin.

10. A connector fitting structure, comprising:

a television receiver cabinet having an opening;

a tuner section provided with a connector receptacle which protrudes through the opening to the outside of the cabinet so as to be exposed on its sides;

a connector adapted to mate outside the cabinet with the protruding connector receptacle; and at least one pair of enforcement ribs fixed on the cabinet only about substantially horizontal side portions of the opening while keeping the substantially vertical side portions clear of any access inhibiting obstructions, said ribs extending away from the cabinet so as to restrict horizontal movement of the protruding connector receptacle, whereby breakage due to said movement is prevented.

11. The connector fitting structure as set forth in claim 2, wherein the enforcement ribs are protruded so as to extend to a portion where the tightened female-screw connector situates.

12. The connector fitting structure as set forth in claim 2, wherein an interval of the enforcement ribs is wider than a diameter of the female-screw connector.

* * * * *